US011425484B2

(12) United States Patent
Kim et al.

(10) Patent No.: US 11,425,484 B2
(45) Date of Patent: Aug. 23, 2022

(54) EAR WEARABLE DEVICE

(71) Applicant: Samsung Electronics Co., Ltd., Suwon-si (KR)

(72) Inventors: Hongki Kim, Suwon-si (KR); Kyuho Lee, Suwon-si (KR); Kiwook Han, Suwon-si (KR); Jungsoo Kim, Suwon-si (KR); Ikhyun Cho, Suwon-si (KR); Chijeong Choi, Suwon-si (KR); Yongsang Yun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/173,030

(22) Filed: Feb. 10, 2021

(65) Prior Publication Data

US 2021/0250676 A1 Aug. 12, 2021

(30) Foreign Application Priority Data

Feb. 10, 2020 (KR) ..... 10-2020-0015748

(51) Int. Cl.
*H04R 1/10* (2006.01)

(52) U.S. Cl.
CPC ..... *H04R 1/1041* (2013.01); *H04R 1/1016* (2013.01); *H04R 2420/07* (2013.01)

(58) Field of Classification Search
CPC ..... H04R 1/1041; H04R 1/1061
See application file for complete search history.

(56) References Cited

U.S. PATENT DOCUMENTS

| | | | | |
|---|---|---|---|---|
| 9,210,497 | B2 | 12/2015 | Grinnip, III | |
| 10,117,012 | B2 | 10/2018 | Saulsbury et al. | |
| 10,893,355 | B2 | 1/2021 | Huang | |
| 2018/0046305 | A1* | 2/2018 | Kang | H04M 1/0266 |
| 2019/0197281 | A1* | 6/2019 | Choi | H01L 27/3225 |
| 2020/0107105 | A1 | 4/2020 | Feng et al. | |

(Continued)

FOREIGN PATENT DOCUMENTS

| | | | |
|---|---|---|---|
| CN | 206364974 | U | 7/2017 |
| CN | 110049398 | A | 7/2019 |
| JP | 2011-082840 | A | 4/2011 |

(Continued)

OTHER PUBLICATIONS

International Search Report dated May 10, 2021 in connection with International Patent Application No. PCT/KR2021/001401, 3 pages.

(Continued)

*Primary Examiner* — Simon King

(57) ABSTRACT

An ear wearable device includes a housing, a speaker, a structure, nonconductive supporting member, and an Integrated Circuit (IC). The housing includes a nonconductive cover. The speaker is positioned in the housing. The structure is positioned in the housing and includes a nonconductive supporting member facing the nonconductive cover and positioned in the housing, and a first conductive pattern positioned on the nonconductive supporting member. The nonconductive bonding member is positioned between the structure and the nonconductive cover. The touch sensor IC is positioned in the housing and electrically connected with the first conductive pattern.

20 Claims, 10 Drawing Sheets

(56) References Cited

U.S. PATENT DOCUMENTS

2021/0167487 A1* 6/2021 Varma ..... H01Q 25/005

FOREIGN PATENT DOCUMENTS

| | | | |
|---|---|---|---|
| JP | 3221202 | U | 5/2019 |
| KR | 10-2013-0105562 | A | 9/2013 |
| KR | 10-1584246 | B1 | 1/2016 |
| KR | 10-2071684 | B1 | 1/2020 |

OTHER PUBLICATIONS

Written Opinion of the International Searching Authority dated May 10, 2021 in connection with International Patent Application No. PCT/KR2021/001401, 4 pages.

* cited by examiner

EAR WEARABLE DEVICE

CROSS-REFERENCE TO RELATED APPLICATION

This application is based on and claims priority under 35 U.S.C. 119 to Korean Patent Application No. 10-2020-0015748 filed on Feb. 10, 2020 in the Korean Intellectual Property Office, the disclosure of which is herein incorporated by reference in its entirety.

BACKGROUND

1. Field

Various embodiments relate to an ear wearable device.

2. Description of Related Art

With the development of digital technology, electronic devices are provided in various types such as a smartphone, a tablet Personal Computer (PC), or a Personal Digital Assistant (PDA). Electronic devices are developed even in the type that can be worn on a user to be able to improve portability and accessibility for users. For example, an electronic device may be an ear wearable device that can be worn in an ear of a user.

The above information is presented as background information only to assist with an understanding of the disclosure. No determination has been made, and no assertion is made, as to whether any of the above might be applicable as prior art with regard to the disclosure.

SUMMARY

An ear wearable device may include a touch detection circuit that detects touch input. For example, the touch detection circuit may be positioned close to a housing that forms the external appearance of the ear wearable device. However, there may be a gap (e.g., an air gap) between the housing and the touch detection circuit, which may deteriorate the performance of the touch detection circuit detecting user input.

The ear wearable device may include an antenna for wireless communication with an external electronic device. Since the ear wearable device is supposed to be worn in an ear of a user, it may be manufactured in a small size, but, for this reason, it may be difficult to dispose an antenna while securing the radio performance in a limited installation space. Further, when the ear wearable device is worn in an ear of a user, the radio performance may be deteriorated by the body of the user.

An embodiment may provide an ear wearable device that can improve the performance of a touch detection circuit detecting user input.

An embodiment may provide an ear wearable device in which an antenna is disposed to be able to secure radio performance and reduce influence by the body of a user.

According to an embodiment, an ear wearable device includes: a housing including a nonconductive cover; a speaker positioned in the housing; a structure positioned in the housing and including a nonconductive supporting member facing the nonconductive cover and positioned in the housing, and a first conductive pattern positioned on the nonconductive supporting member; a nonconductive bonding member positioned between the structure and the nonconductive cover; and a touch sensor Integrated Circuit (IC) positioned in the housing and electrically connected with the first conductive pattern.

According to an embodiment, an electronic device includes: a housing having a nonconductive region exposed to the outside; a structure positioned in the housing and including a nonconductive supporting member facing the nonconductive region and positioned in the housing, and a first conductive pattern positioned on the nonconductive supporting member; a nonconductive bonding member positioned between the structure and the nonconductive region; and a touch sensor Integrated Circuit (IC) positioned in the housing and electrically connected with the first conductive pattern.

According to an embodiment, a nonconductive bonding member positioned in the electronic device fills the gap (e.g., an air gap) between a structure including a touch detection circuit and a nonconductive cover forming the external appearance of the ear wearable device, thereby being able to improve the detection performance of the touch detection circuit.

According to an embodiment the nonconductive bonding member positioned in the electronic device not only contributes to coupling between the structure including a touch detection circuit and the nonconductive cover forming the external appearance of the ear wearable device, but also can increase permittivity of the touch detection circuit.

According to an embodiment, an antenna is disposed in the structure including the touch detection circuit, thereby being able to not only overcome a limited antenna design space of the ear wearable device, but also secure the radiation performance and reduce the influence on the body of a user.

Effects that can be obtained or expected from other various embodiments will be directly or suggestively disclosed in the detailed description of embodiments. For example, various effects that are expected from various embodiments will be described in the following detailed description.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code"

includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrase.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
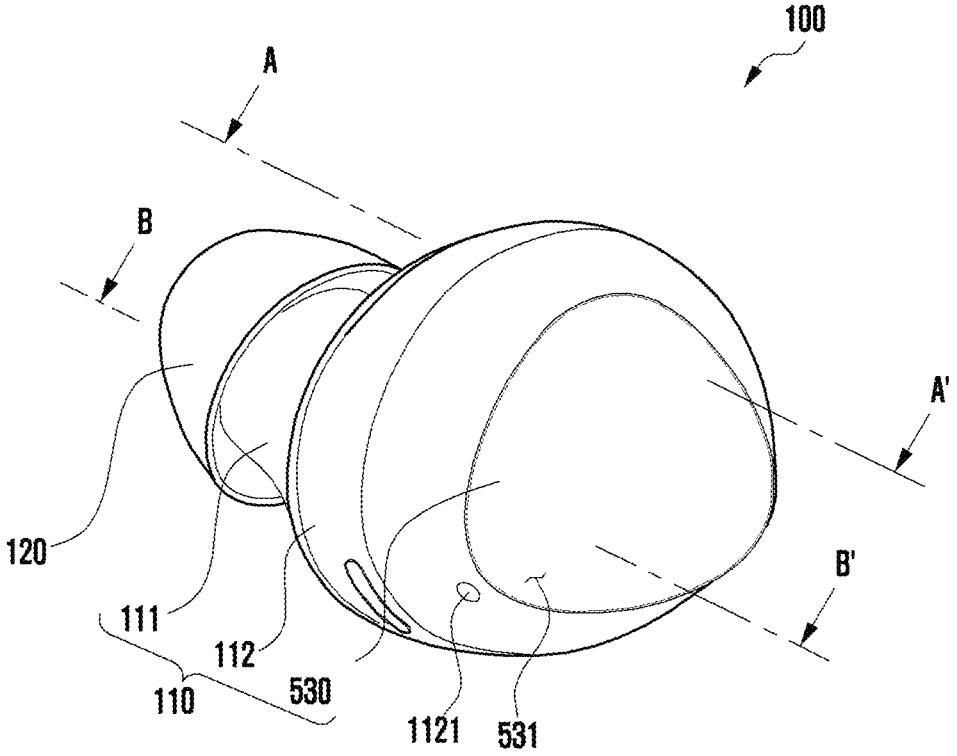
FIG. 1 illustrates a perspective view of an ear wearable device according to an embodiment.

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, various embodiments of the disclosure will be described with reference to the accompanying drawings.

It should be appreciated that the embodiments and the terms used therein are not intended to limit the technological features set forth herein to particular embodiments and include various changes, equivalents, and/or alternatives for a corresponding embodiment. With regard to the description of the drawings, similar reference numerals may be used to designate similar or relevant elements. It is to be understood that a singular form of a noun corresponding to an item may include one or more of the things, unless the relevant context clearly indicates otherwise. As used herein, such phrases as "A or B" and "at least one of A and/or B" may include all possible combinations of the items enumerated together in the corresponding phrase. As used herein, such terms as "a first", "a second", "the first", and "the second" may modify corresponding elements regardless of the order and/or the importance thereof. These terms may be used to simply distinguish a corresponding element from another, and does not limit the elements. It should be understood that when an element (e.g., first element) is referred to as being (operatively or communicatively) "connected" or "coupled" to another element (e.g., second element), it means that the element may be coupled with the other element directly or via another element (e.g., third element).

The expression "configured to" used in the disclosure may be interchangeably used with, for example, "suitable for", "having the capacity to", "adapted to", "made to", "capable of", or "designed to" in hardware or software. Alternatively, in some situations, the expression "device configured to" may mean that the device, together with other devices or components, "is able to".

Figure 2:
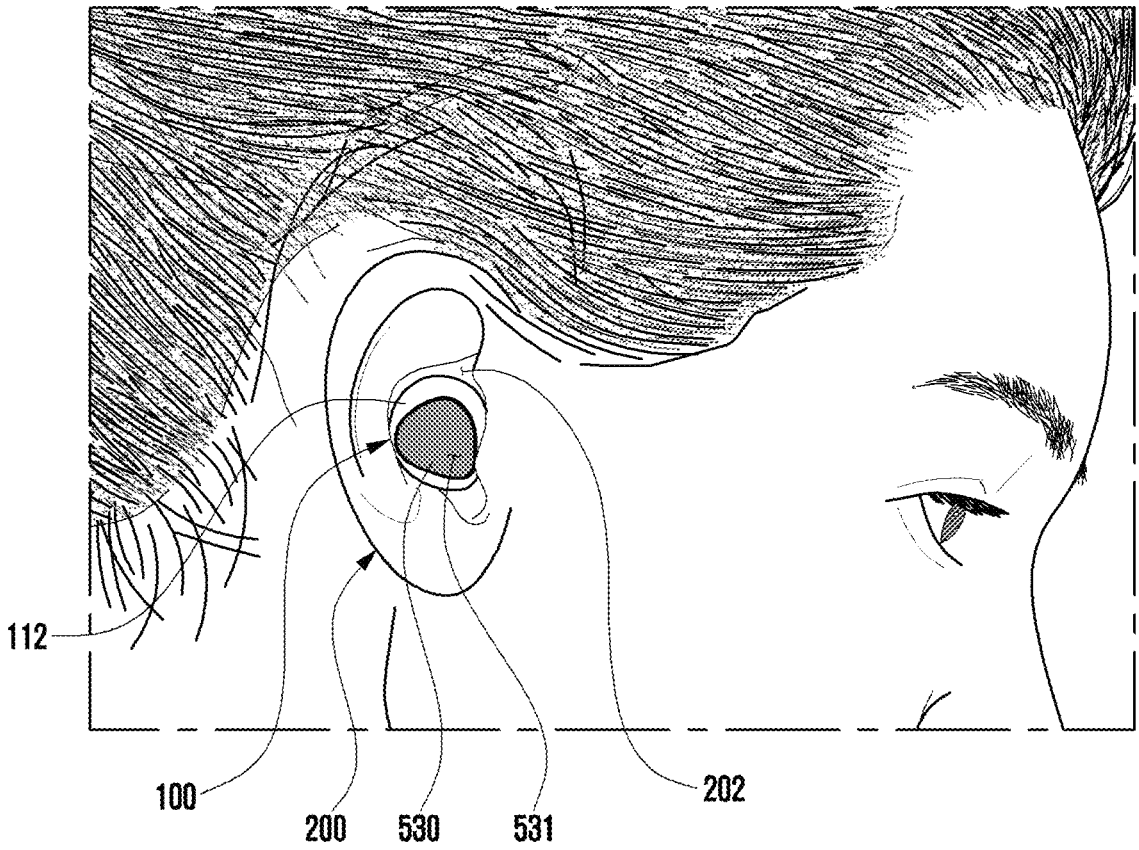
FIG. 2 illustrates the state in which the ear wearable device according to an embodiment is inserted in an ear of a user.

FIG. 1 illustrates a perspective view of an ear wearable device 100 according to an embodiment. FIG. 2 illustrates the state in which the ear wearable device 100 according to an embodiment is inserted in an ear of a user.

Referring to FIGS. 1 and 2, in an embodiment, an ear wearable device 100 may include a housing 110 or an ear tip 120.

The housing 110, for example, may be formed in a shape that can be detachably inserted in an ear 200 of a user. According to an embodiment, the housing 110 may have a first section 111 that can be at least partially inserted in the external auditory canal (not shown) of the ear 200 and a second section 112 that can be seated in a groove 202 the auricle connected to the external auditory canal. The ear wearable device 100 may include a speaker disposed in the housing 110 (e.g., a speaker 341 shown in FIG. 3). A sound output from the speaker can be discharged through the first section 111 inserted in the external auditory canal of the ear 200 and then transmitted to the eardrum of the ear 200. At least a portion of the housing 110 may be made of various materials such as a polymer or metal.

The ear tip 120, for example, may be coupled to the first section 111 of the housing 110. The ear tip 120 may be a hollow flexible member and the first section 111 of the housing 110 can be inserted in a channel of the ear tip 120. For example, the ear tip 120 may be seated in a grooved formed at the first section 111 of the housing 110 and coupled to the first section 111. When the first section 111 of the housing 110 is inserted in the external auditory canal of the ear 200, the ear tip 120 may be elastically positioned between the external auditory canal of the ear and the first section 111 of the housing 110. The ear tip 120 may be detachably coupled to the first section 111 of the housing 110 and may have various sizes and shapes.

According to an embodiment, the housing 110 may include a nonconductive cover 530 coupled to the second section 112. When the housing 110 is inserted in the ear 200 of a user, the nonconductive cover 530 may be exposed outside the ear 200. A surface 531 formed by the nonconductive cover 530 may be a curved surface smoothly connected to the outer surface of the second section 112. The surface 531 formed by the nonconductive cover 530 may be a flat surface.

According to an embodiment, the surface 531 of the nonconductive cover 530 may be used as an input area (or a key area) for receiving or detecting user input. Touch input, hovering input, or gesture input is possible through the surface 531 with the ear wearable device 100 worn in the ear 200 of a user. The hovering input, for example, may be user input that can be generated without a finger touching the surface 531. The gesture input, for example, may be input related to finger movements (or finger movement patterns).

According to an embodiment, a mic hole 1121 may be formed at the second section 112 of the housing 110. The mic hole 1121 may be exposed to the outside when the ear wearable device 100 is worn in the ear 200 of a user. The position or the number of pieces of the mic hole 1121 may be varied without being limited to the embodiment of FIG. 1.

Figure 3:
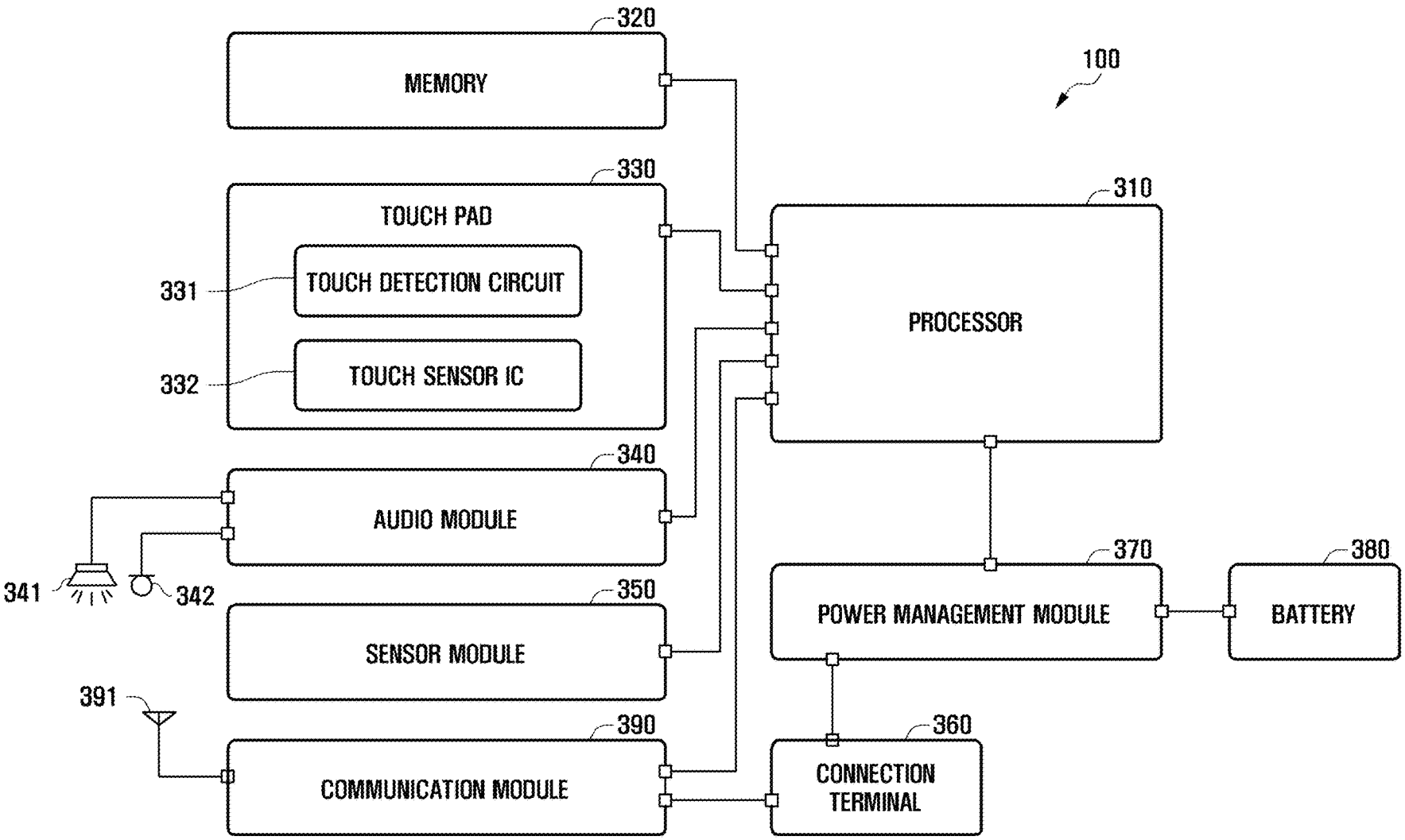
FIG. 3 illustrates a block diagram of the ear wearable device of FIG. 1 according to an embodiment.

FIG. 3 illustrates a block diagram of the ear wearable device 100 of FIG. 1 according to an embodiment;

Referring to FIG. 3, in an embodiment, the ear wearable device 100 may include a processor 310, a memory 320, a touch pad 330, an audio module 340, a speaker 341, a microphone 342, a sensor module 350, a connection terminal 360, a power management module 370, a battery 380, a communication module 390, or at least one antenna 391. According to a certain embodiment, in the ear wearable device 100, at least one of the components shown in FIG. 3 may not be provided or one or more other components may be added. According to certain embodiment, some of the components may be implemented in one unified circuit.

The processor 310, for example, can control at least one other component (e.g., a hardware or software component) connected to the processor 310 of the ear wearable device 100 and can process or calculate various data by executing software. According to an embodiment, as at least a portion of data processing or calculating, the processor 310 can load a command or data received from another component (e.g., the sensor module 350 or the communication module 390) on a volatile memory of the memory 320, process the command or data stored in the volatile memory, and store resultant data in a nonvolatile memory.

The memory 320, for example, can store various data that are used by at least one component (e.g., the processor 310 or the sensor module 350) of the ear wearable device 100. The data, for example, may include software (e.g., a program) and input data or output data about command related to the software. The memory 320 may include a volatile memory or a nonvolatile memory. Programs may be stored as software in the memory 320, and for example, may include an operating system, a middleware, or an application. The memory 320, for example, can store instructions related to various operations that are performed by the processor 310.

Referring to FIGS. 1 to 3, the touch pad 330, for example, is a pointing device that uses the surface 531 of the nonconductive cover 530 of the housing 110 and may include a touch detection circuit 331 and a touch sensor integrated circuit (IC) (or a touch sensor) 332. According to an embodiment, the touch detection circuit 331 may include a conductive pattern disposed in the housing 110. The nonconductive cover 530 may be disposed to overlap at least a portion of the touch detection circuit 331. The surface 531 of the nonconductive cover 530 may be used as an input area (or a key area) for receiving or detecting user input. According to an embodiment, the touch pad 330 may be implemented, based on a capacitance type. The touch sensor IC 332 (e.g., a touch control IC (integrated circuit) can apply a voltage to the touch detection circuit 331 and the touch detection circuit 331 can generate an electromagnetic field. For example, when a finger touches the surface 531 of the nonconductive cover 530 and reaches a critical distance from the surface 531 of the nonconductive cover 530, a change of capacitance based on a change of an electromagnetic field may be a critical value or higher. When a change of capacitance is the critical value or higher, the touch sensor IC 332 can generate and transmit an electrical signal related to coordinates to the processor 310 as effective user input. The processor 310 can recognize coordinates, based on the electrical signal received from the touch sensor IC 332. The touch detection circuit 331 and the touch sensor IC 332 may be, in combination, referred to as a sensor circuit for detecting a touch. According to various embodiments, the key area included in the surface 531 of the nonconductive cover 530 and the touch detection circuit 331 corresponding to the key area may be, in combination, referred to a touch key. The touch pad 330 can contribute to making the external appearance of the ear wearable device 100 smooth and integrated by forming a touch detection circuit to fit to the shape of the housing.

According to various embodiments, the touch sensor IC 332 can convert an analog signal obtained through the touch detection circuit 331 into a digital signal. According to various embodiments, the touch sensor IC 332 can perform various functions such as filtering out noise, removing noise, or extracting sensing data in relation to the touch detection circuit 331. According to various embodiments, the touch sensor IC 332 may include various circuits such as an Analog-Digital Converter (ADC), a Digital Signal Processor (DSP), and/or a Micro Control Unit (MCU).

According to an embodiment, user input related to audio data (or audio contents) may be generated through the touch pad 330. For example, functions such as playing audio data, temporarily stopping playback, stopping playback, controlling a playback speed, controlling volume, or muting may be performed, based on user input through the touch pad 330. Referring to FIG. 1, in various embodiments, it is possible to input various gestures through the key area included in the surface 531 of the nonconductive cover 530 using a finger, and various functions related to audio data can be performed, based on the gesture input. For example, when the key area of the nonconductive cover 530 is tapped one time, the processor 310 can play audio data or stop playback of the audio data. For example, when the key area of the nonconductive cover 530 is tapped two times, the processor 310 can play the next audio data. For example, when the key area of the nonconductive cover 530 is tapped three times, the processor 310 can play the previous audio data. For example, when the key area of the nonconductive cover 530 is swiped, the processor 310 can adjust the volume about playback of audio data. Gesture input may be used not only for the functions related to audio data, but also for other various functions. For example, when there is a phone call, the processor 310 can receive the call when the key area of the nonconductive cover 530 is tapped two times.

According to various embodiments, the touch pad 330 may further include a tactile layer (not shown). The touch pad 330 including the tactile layer can provide a tactual sense reaction to a user.

According to a certain embodiment, there may be a click button (not shown) aligned with the touch pad 330, and when the nonconductive cover 530 is pressed, input like clicking a mouse button may be generated. According to an embodiment, the touch pad 330 may include a sensor circuit (e.g., a pressure sensor) (not shown) that is configured to measure the magnitude of force that is generated by user input.

According to various embodiments, the ear wearable device 100, other than the touch pad 330, may further include other various input devices configured to receive commands or data to be used for components (e.g., the processor 310) of the ear wearable device 100 from the outside (e.g., a user) of the ear wearable device 100. The input devices may be implemented in various ways such as a physical button or an optical key.

The speaker 341, for example, can output an audio signal to the outside of the ear wearable device 100. A sound wave such as a sound or a voice can travel into the microphone 342 through the mic hole 1121 (see FIG. 1), and the microphone 342 can generate an electrical signal corresponding to the sound wave. The audio module 340 can convert a sound into an electrical signal or an electrical signal into a sound. The audio module 340 can obtain a sound through the microphone 342 or can output a sound through the speaker 341.

According to an embodiment, the audio module 340 can support an audio data collection function. The audio module 340 can play collected audio data. The audio module 340 may include an audio decoder, a Digital-to-Analog (D/A) converter, or an Analog-to-Digital (A/D) converter. The audio decoder can convert audio data stored in the memory 320 into a digital audio signal. The D/A converter can convert a digital audio signal converted by the audio decoder into an analog audio signal. The speaker 341 can output the analog audio signal converted by the D/A converter. The A/D converter can convert an analog audio signal obtained through the microphone 342 into a digital audio signal.

The sensor module 350, for example, can detect the operation state (e.g., power or temperature) of the ear wearable device 100 or an external environmental state (e.g., a user state) and can generate an electrical signal or a data value corresponding to the detected state. According to an embodiment, the sensor module 350 may include an acceleration sensor, a gyro sensor, a geomagnetic field sensor, a magnetic sensor, a proximity sensor, a temperature sensor, a gesture sensor, a grip sensor, or bio sensor.

For example, referring to FIG. 1, the ear wearable device 100 may include an optical sensor at least partially disposed in the housing 110 or on a surface of the housing 110. When the optical sensor is disposed in the housing 110, an area of the housing 110 that faces the optical sensor may be implemented to be able to transmit light or may have an opening. The optical sensor may include a light emitter (e.g., a Light Emitting Diode (LED)) that outputs light in at least one wavelength band or a light receiver (e.g., a photodiode) that generates an electrical signal by receiving light in one or more wavelength bands. According to an embodiment, the optical sensor may be a sensor configured to detect wearing. According to an embodiment, the optical sensor may be a bio sensor. When the ear wearable device 100 is worn in an ear of a user, light output from the light emitter of the optical sensor can be reflected by the skin of the user and can enter the light receiver of the optical sensor. The light receiver of the optical sensor can provide an electrical signal based on incident light to the processor 310. The processor 310 can transmit the electrical signal obtained from the optical sensor to an external electronic device (e.g., a smartphone) through the communication module 390. The external electronic device can obtain various items of biological information such as the heart rate or the skin temperature, based on the electrical signal obtained from the ear wearable device 100. According to a certain embodiment, the processor 310 can obtain biological information, based on the electrical signal obtained from the optical sensor, and can transmit the obtained biological information to the external electronic device through the communication module 390 or can output the obtained biological information through the speaker 341.

According to various embodiments, information or a signal about whether the ear wearable device 100 is worn in an ear of a user can be obtained through the sensor module 350. According to various embodiments, information or a signal about whether the ear wearable device 100 is combined with an external device (e.g., a charger) can be obtained through the sensor module 350.

According to various embodiments (not shown), the ear wearable device 100 may include a detected member corresponding to the sensor of the external electronic device (e.g., a charger). For example, the external electronic device may include a Hall IC disposed on a mount, and the ear wearable device 100 may include a magnet (or a magnetic substance). When the ear wearable device 100 is coupled to the mount of the external electronic device, the Hall IC of the external electronic device can detect the magnet disposed in the ear wearable device 100 and can transmit an electronic signal about combination of the external electronic device and the ear wearable device 100 to the processor 310.

The connection terminal 360, for example, may include a connector through which the ear wearable device 100 can be electrically connected with an external electronic device (e.g., a smartphone or a charger). According to an embodiment, the connection terminal 360, for example, may include a USB connector or an SD card connector.

According to various embodiments, the connection terminal 360 may include at least one contact (or terminal) disposed on the outer surface of the housing 110 (see FIG. 1). For example, when the ear wearable device 100 is mounted on the mount (not shown) of an external electronic device, the at least one contact of the ear wearable device 100 can be electrically connected with at least one contact (e.g., a flexible terminal such as a pogo pin) disposed on the mount of the external electronic device. According to an embodiment, the connection terminal 360 can receive power for charging the battery 380 from the external electronic device and transmit the power to the power management module 370. According to an embodiment, the ear wearable device 100 can perform Power Line Communication (PLC) with the external electronic device (e.g., a charger) through the connection terminal 360.

The power management module 370, for example, can manage power that is supplied to the ear wearable device 100. According to an embodiment, the power management module 370 may be implemented as at least a portion of a Power Management Integrated Circuit (PMIC).

The battery 380, for example, can supply power to at least one component of the ear wearable device 100. According to an embodiment, the battery 380 may include a rechargeable secondary battery.

The communication module 390, for example, can support construction of a direct (e.g., wire) communication channel or a wireless communication channel between the ear wearable device 100 and the external electronic device (e.g., a server, a smartphone, a Personal Computer (PC), a Personal Digital Assistant (PDA), or an access point), and communication through the constructed communication channel. According to various embodiments, the communication module 390 can be operated independently from the processor 310 and may include one or more communication processors that support direct (e.g., wire) communication or wireless communication.

The communication module 390, for example, can transmit or receive a signal or power to or from an external electronic device through at least one antenna (or an antenna radiator) 391. According to an embodiment, the communication module 390 may include a wireless communication module (e.g., a near field wireless communication module or a Global Navigation Satellite System (GNSS) communication module) or a wire communication module (e.g., a Local Area Network (LAN) communication module or a power line communication module). A corresponding communication module of these communication modules can communicate with an external electronic device through a first network (e.g., a near field communication network such as Bluetooth, Bluetooth Low Energy (BLE), Near Field Communication (NFC), Wireless Fidelity (WiFi) direction or Infrared Data Association (IrDA) or a second network (e.g., a long distance communication network such as the internet or a computer network (e.g., a LAN or a Wide Area Network (WAN)). These kinds of communication modules may be integrated into one component (a single chip) or may be composed of a plurality of separate components (e.g., a plurality of chips). According to various embodiments, the ear wearable device 100 may include a plurality of antennas and the communication module 390 can select at least one antenna, which is suitable for the communication type that is used in a communication network, from the antennas. A signal or power can be transmitted or received between the communication module 390 and an external electronic device through the selected at least one antenna.

According to an embodiment, all or some of the operations that are performed in the ear wearable device 100 may be performed in one or more external electronic device (e.g., a smartphone). For example, when the ear wearable device 100 needs to perform a predetermined function or service automatically or in response to a request from a user or another device, the ear wearable device 100 can request at least one external electronic device to perform at least a portion of the function or the service additionally or instead of performing the function or the service by itself. The at least one external electronic device receiving the request can perform at least a portion of the requested function or service or an additional function or service related to the request, and can transmit the result of the performance to the ear wearable device 100. The ear wearable device 100 can intactly or additionally process the result and then provide as at least a portion of the response to the request.

According to various embodiments, a command or data received by the processor 310 may be transmitted or received between the ear wearable device 100 and an external electronic device (e.g., a smartphone) through a server connected to the second network (e.g., a long distance communication network such as the internet or a computer network (e.g., a LAN or a WAN)).

According to an embodiment, the processor 310 may be configured to control the flow of various signals related to audio data and to control information collection and output. The processor 310 may be configured to receive audio data from an external electronic device (e.g., a server, a smartphone, a PC, a PDA, or an access point) through the communication module 390 and to store the received audio data in the memory 320. The processor 310 may be configured to receive nonvolatile audio data (or download audio data) from an external electronic device and to store the received nonvolatile audio data in a nonvolatile memory. The processor 310 may be configured to receive volatile audio data (or streaming audio data) from an external electronic device and to store the received volatile audio data in a volatile memory.

According to an embodiment, the processor 310 may be configured to play the audio data (e.g., the nonvolatile audio data or the volatile audio data) stored in the memory 320 such that the audio data are output through the speaker 341. For example, the audio module 340 can generate an audio signal that can be output through the speaker 341 by decoding audio data (e.g., play audio data), and the generated audio signal can be output through the speaker 341.

According to various embodiments, the processor 310 may be configured to receive an audio signal from an external electronic device and to output the received audio signal through the speaker 341. For example, an external electronic device (e.g., an audio playback device) can generate an audio signal by decoding audio data and can transmit the generated audio signal to the ear wearable device 100.

According to various embodiments, the mode in which the ear wearable device 100 plays and outputs the volatile audio data or nonvolatile audio data stored in the memory 320 through the speaker 341 may be temporarily stopped when the state in which the ear wearable device 100 is not inserted in an ear of a user is determined by the sensor module 350. When the state in which the ear wearable device 100 is inserted in an ear of a user is determined by the sensor module 350, the mode can be restarted.

According to various embodiments, the mode in which an audio signal is provided from an external electronic device and output through the speaker 341 may be temporarily stopped when the state in which the ear wearable device 100 is not inserted in an ear of a user is determined by the sensor module 350. When the state in which the ear wearable device 100 is inserted in an ear of a user is determined by the sensor module 350, the mode can be restarted.

According to various embodiments, when the ear wearable device 100 is connected with another ear wearable device (not shown) for communication, one ear wearable device may be a master device and the other one may be a slave device. For example, the ear wearable device 100 that is a master device not only can output an audio signal received from an external electronic device (e.g., a smartphone) to the speaker 341, but also can transmit the audio signal to another ear wearable device. The other ear wearable device may be implemented substantially to be the same as the ear wearable device 100 and can output the audio signal received from the ear wearable device 100 through a speaker.

According to various embodiments, the ear wearable device 100 can provide a voice recognition function that generates a voice command from an analog audio signal received through the microphone 342. The voice command can be used for various functions related to audio data.

According to various embodiments, the ear wearable device 100 may include a plurality of microphones (e.g., the microphone 342) to be able to detect the direction of sound. At least some of the microphones may be used for noise-canceling.

According to various embodiments, the ear wearable device 100 may further include various modules, depending on the provided types. Although it is difficult to state all kinds of modules because of various changes depending on the convergence tendency of digital devices, the same level of components as the components stated above may be further included in the ear wearable device 100. Further, it is apparent that the specific components of the components described above may not be provided or may be replaced with other components in the ear wearable device 100, depending on the provided types. This will be easily understood by those skilled in the art.

Figure 4:
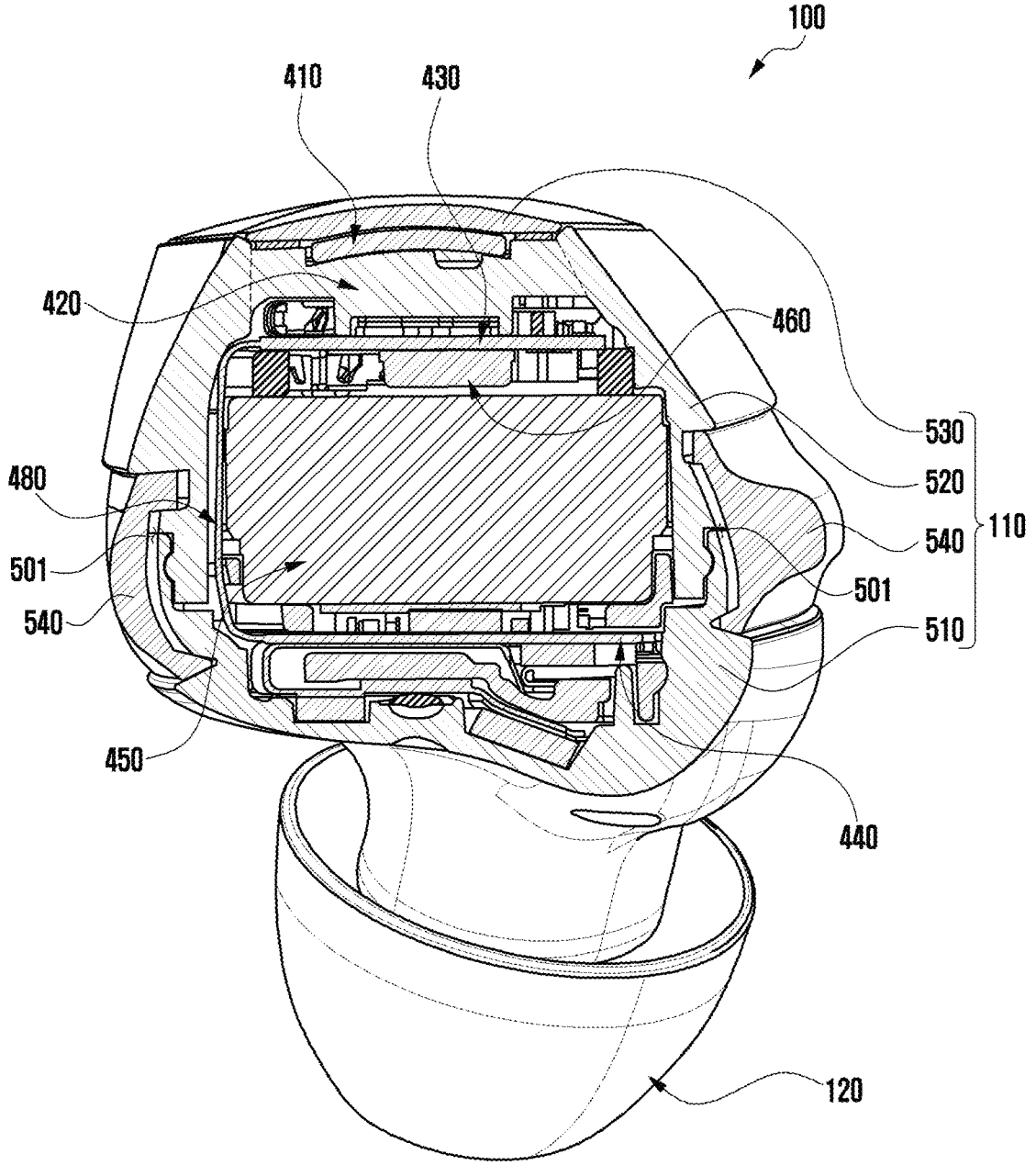
FIG. 4 illustrates a cross-sectional view taken along line A-A' of the ear wearable device shown in FIG. 1 according to an embodiment.
Figure 5:
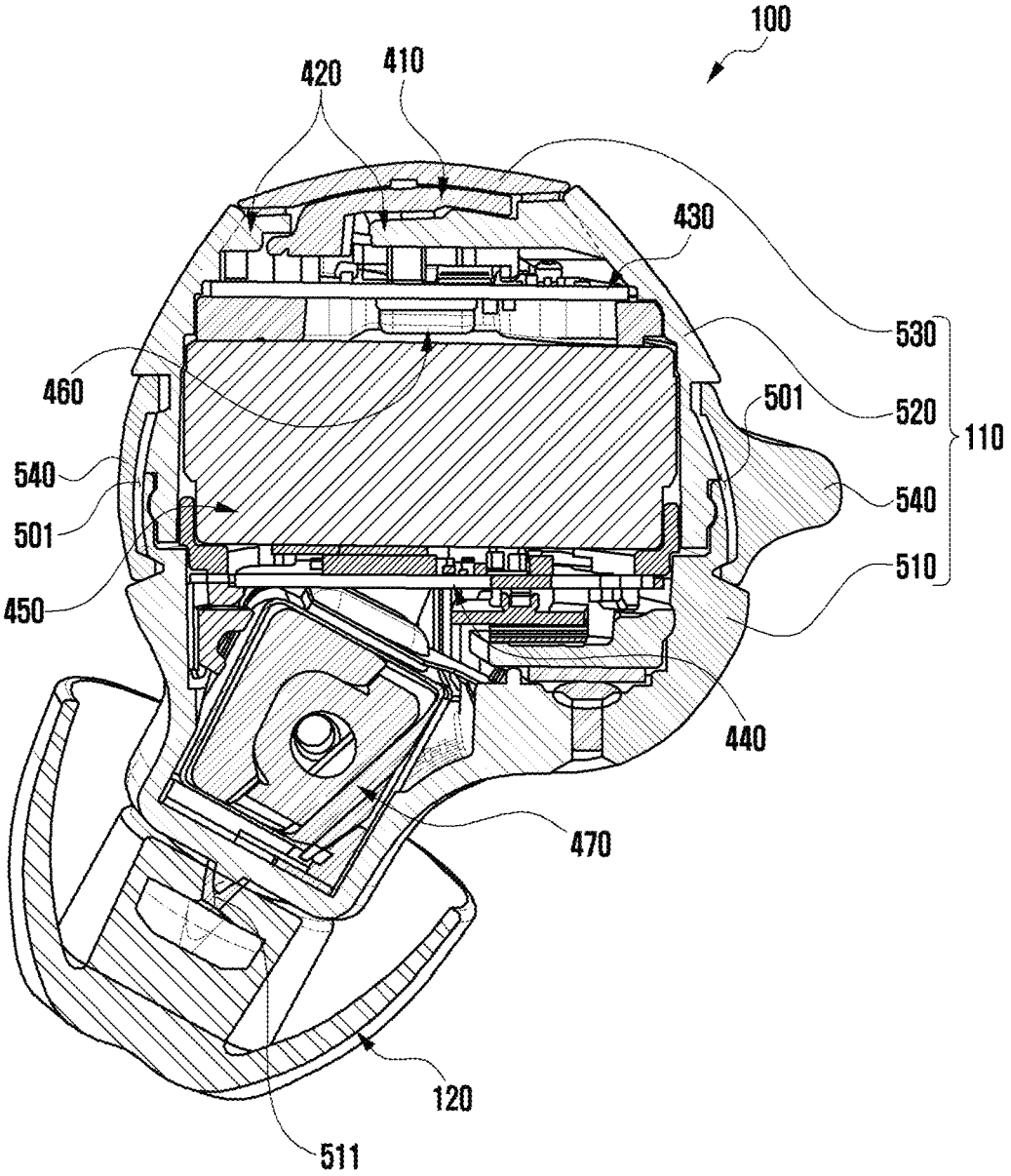
FIG. 5 illustrates a cross-sectional view taken along line B-B' of the ear wearable device shown in FIG. 1 according to an embodiment.

FIG. 4 illustrates a cross-sectional view taken along line A-A' of the ear wearable device 100 of FIG. 1 according to an embodiment. FIG. 5 illustrates a cross-sectional view taken along line B-B' of the ear wearable device 100 of FIG. 1 according to an embodiment.

Referring to FIGS. 4 and 5, in an embodiment, the ear wearable device 100 may include a housing 110, an ear tip 120, a first supporting member 410, a second supporting member 420, a first printed circuit board 430, a second printed circuit board 440, a battery 450 (e.g., the battery 380 shown in FIG. 3), a microphone 460 (e.g., the microphone 342 shown in FIG. 3), a speaker 470 (e.g., the speaker 341 shown in FIG. 3), or a Flexible Printed Circuit Board (FPCB) 480.

According to an embodiment, the housing 110 may have a first housing section (e.g., the first section 111 shown in FIG. 1), a second housing section 520 (e.g., the second section 112 shown in FIG. 1), a nonconductive cover 530, and a rim 540. The first housing section 510 may be an external appearance member to which the ear tip 120 is coupled and the second housing section 520 may be an external appearance member to which the nonconductive cover 530 is coupled. The first printed circuit board 430, the second printed circuit board 440, the battery 450, the microphone 460, the speaker 470, and the FPCB 480 may be disposed in an internal space defined by combination of the first housing section 510 and the second housing section 520. The rim 540 may be disposed at the connecting portion (not shown) between the first housing section 510 and the second housing section 520. The connecting portion between the first housing section 510 and the second housing section 520, for example, may have a coupling structure based on snap-fit with the edge of the first housing section 510 and the edge of the second housing section 520 partially overlapping each other. The connecting portion between the first housing section 510 and the second housing section 520 may have a ring-shaped recess 501. The rim 540 may be disposed in the ring-shaped recess 501 and may form at least a portion of the outer surface of the housing 110 while covering the connecting portion between the first housing section 510 and the second housing section 520. The rim 540 is detachable and may have various shapes corresponding to the grooves inside auricles. According to various embodiments, the rim 540 may be made of a flexible material and can elastically press the groove inside the auricle when the housing 110 is inserted in an ear of a user.

According to an embodiment, the second supporting member 420 is disposed in the housing 110 and may be connected with the second housing section 520 or may be integrated with the second housing section 520. The second supporting member 420 may at least partially extend between the nonconductive cover 530 and the first printed circuit board 430. At least a portion of the second supporting member 420 may be made of a nonmetallic material (e.g., a polymer) or a metallic material.

According to an embodiment, the first supporting member 410 may be disposed in the housing 110 and may be positioned between the nonconductive cover 530 and the second supporting member 420. The first supporting member 410 may be combined with the second supporting member 420 and/or the nonconductive cover 530. The first supporting member 410 may be made of a nonconductive material such as a polymer.

According to an embodiment, the touch detection circuit 331 shown in FIG. 3 may be positioned at the first supporting member 410. For example, the touch detection circuit 331 shown in FIG. 3 may have a first conductive pattern disposed at the first supporting member 410 (e.g., a first conductive pattern 610 shown in FIG. 7). The first conductive pattern may at least partially extend between the nonconductive cover 530 and the first supporting member 410. A portion of the first conductive pattern, which is a terminal, may extend between the first supporting member 410 and the first printed circuit board 430 and may be electrically connected to the first printed circuit board 430 through a flexible conductive member such as a C-clip (e.g., a C-shaped spring), a pogo-pin, a spring, a conductive PORON, a conductive rubber, a conductive tape, or a copper connector. The touch sensor IC 332 shown in FIG. 3 and disposed on the first printed circuit board 430 or the second printed circuit board 440 can apply voltage to the first conductive pattern and the first conductive pattern can generate an electromagnetic field for detecting and receiving user input. According to an embodiment, the processor 310 can detect that a user wears the ear wearable device 100 and can control the touch sensor IC 332 to apply voltage to the first conductive pattern, based on the detection result.

According to an embodiment, the at least one antenna 391 shown in FIG. 3 may be positioned at the first supporting member 410. For example, the at least one antenna 391 shown in FIG. 3 may have a second conductive pattern disposed at the first supporting member 410. The second conductive pattern may be physically (or electrically) separated from the first conductive pattern implemented for the touch detection circuit 331 shown in FIG. 3. The second conductive pattern may at least partially extend between the nonconductive cover 530 and the first supporting member 410. A portion of the second conductive pattern, which is a terminal, may extend between the first supporting member 410 and the first printed circuit board 430 and may be electrically connected to the first printed circuit board 430 through a flexible conductive member such as a C-clip, a pogo-pin, a spring, a conductive PORON, a conductive rubber, a conductive tape, or a copper connector. The communication module 390 shown in FIG. 3 and disposed on the first printed circuit board 430 or the second printed circuit board 440 can transmit or receive a signal to or from an external electronic device through the second conductive pattern.

According to an embodiment, the first printed circuit board 430 may be positioned between the second supporting member 420 and the battery 450. The microphone 460 may be disposed on the first printed circuit board 430 between the first printed circuit board 430 and the battery 450. The ear wearable device 100 may have a sound transmission path (or channel) (not shown) that transmits sound traveling inside through at least one mic hole (e.g., the mic hole 1121 shown in FIG. 1) formed at the second housing section 520 to the microphone 460. For example, the first printed circuit board 430 may have at least one through-hole (or opening) overlapping the microphone 460 and sound traveling inside through the mic hole 1121 can travel to the microphone 460 through the at least one through-hole.

According to an embodiment, the second printed circuit board 440 may be positioned opposite to the first printed circuit board 430 with the battery 450 therebetween. The second printed circuit board 440 may be at least partially positioned between the battery 450 and the speaker 470. The speaker 470 may be positioned in the housing 110 to output sound toward the eardrum of a user when the housing 110 is worn in the ear of the user. The speaker 470 may be electrically connected to the second printed circuit board 440. The ear wearable device 100 may have a sound transmission path (or channel) (not shown) that discharges sound output from the speaker 470 to the outside through an opening (e.g., a sound outlet) 511 of the first housing section 510 combined with the ear tip 120.

According to an embodiment, the first printed circuit board 430 and the second printed circuit board 440 may be electrically connected through various electrical paths such as the FPCB 480. The FPCB 480 may extend between the battery 450 and the housing 110. The processor 310, the memory 320, the touch sensor IC 332, the audio module 340, the sensor module 350, the communication module 390, the power management module 370, or the connection terminal 360 shown in FIG. 3 may be disposed on the first printed circuit board 430 or the second printed circuit board 440.

According to various embodiments, the first printed circuit board 430, the second printed circuit board 440, and the FPCB 480 may be implemented as an integrated rigid flexible printed circuit board. According to a certain embodiment, the first printed circuit board 430 and the FPCB 480 or the second printed circuit board 440 and the FPCB 480 may be implemented as an integrated rigid flexible printed circuit board.

According to an embodiment, the ear wearable device 100 may include a nonconductive bonding member (not shown) positioned between the nonconductive cover 530 and the first supporting member 410. The nonconductive bonding member may fill the gap between the first supporting member 410 and the nonconductive cover 530 and/or the gap between the touch detection circuit 331 (see FIG. 3) and the nonconductive cover 530, and may influence the electromagnetic field that is generated by the touch detection circuit 331. According to an embodiment, the nonconductive bonding member can reduce the air gap between the first supporting member 410 and the nonconductive cover 530 and/or the air gap between the touch detection circuit 331 and the nonconductive cover 530. The nonconductive bonding member not only contributes to physical coupling between the nonconductive cover 530 and the first supporting member 410, but also can increase permittivity related to the electromagnetic field, whereby the performance of detecting user input (e.g., touch input, hovering input, or gesture input) through the touch detection circuit 331 can be improved.

According to a certain embodiment, the nonconductive cover 530 and the second housing section 520 may be integrated and may include the same polymer. In this case, a partial region of the second housing section 520 may be positioned to face the first supporting member 410, as a nonconductive region. According to a certain embodiment, the nonconductive cover 530 and the first supporting member 410 may be integrated, and the first conductive pattern may be disposed at the integrated nonconductive cover 530 and/or first supporting member 410.

According to a certain embodiment, a portion of the second housing section 520 may be made of a metallic material.

Figure 6:
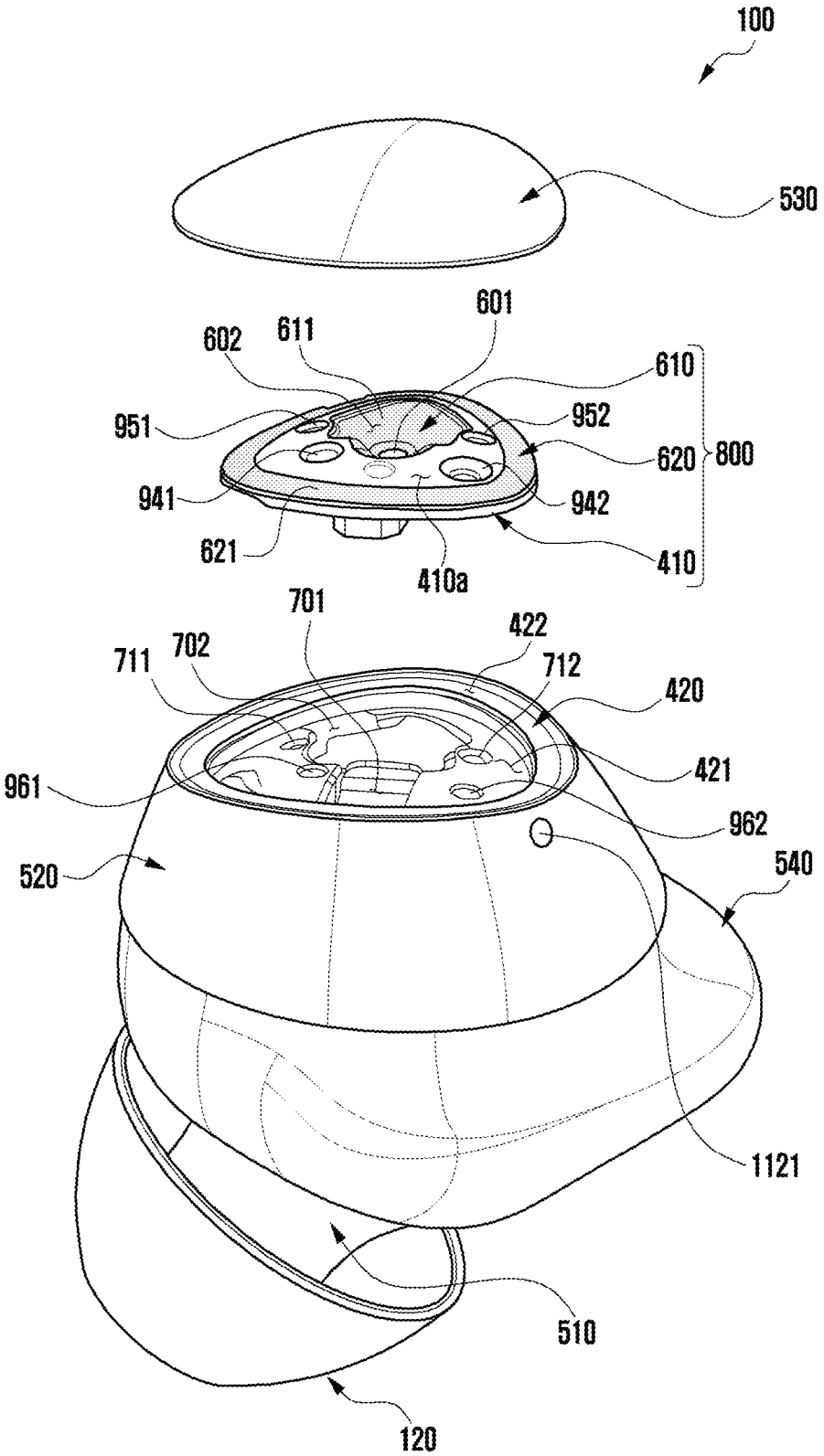
FIG. 6 illustrates an exploded perspective view of a portion of the ear wearable device shown in FIG. 1 according to an embodiment.
Figure 7:
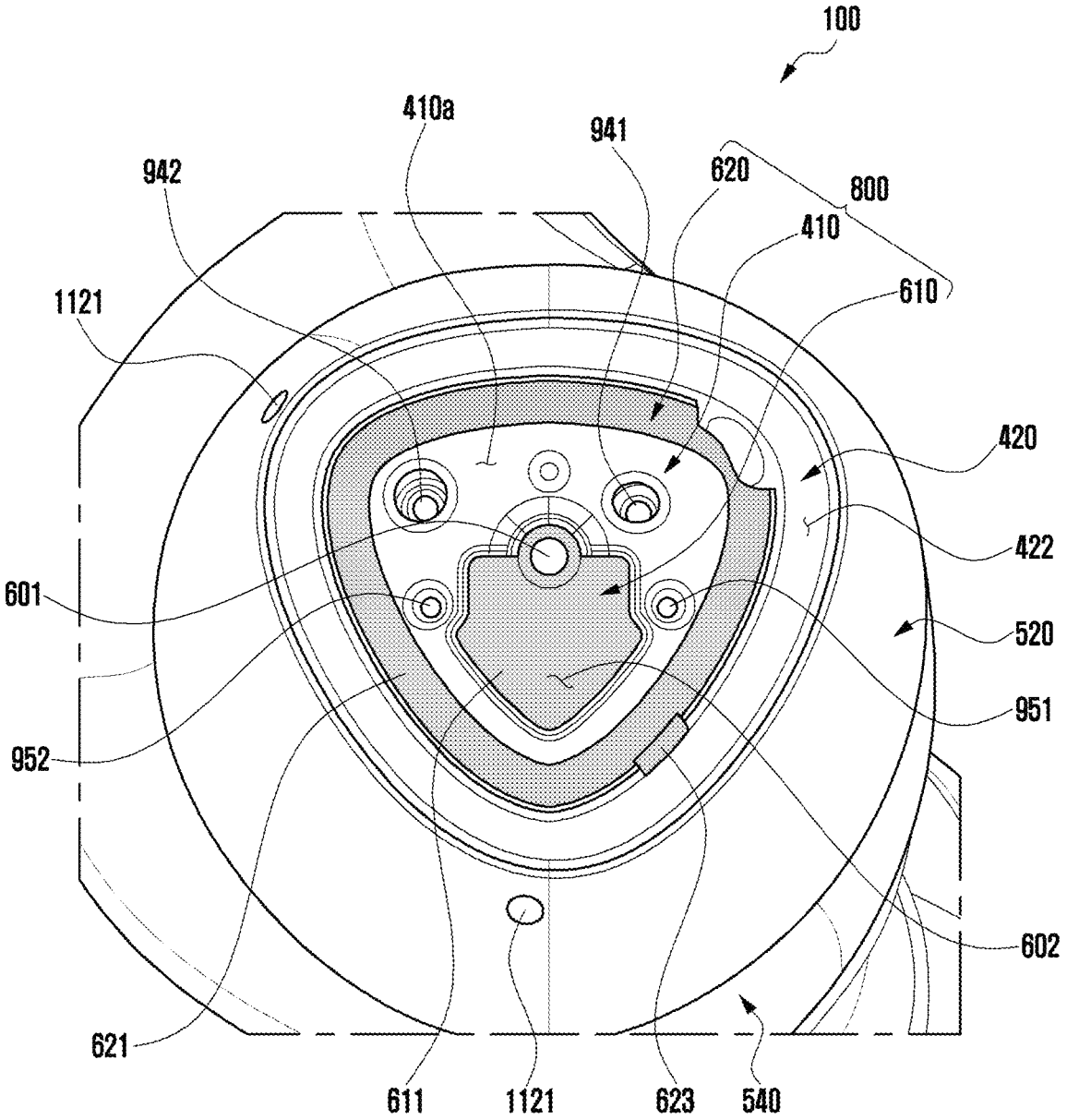
FIG. 7 illustrates the state in which a nonconductive cover is separated from the ear wearable device shown in FIG. 1 according to an embodiment.

FIG. 6 illustrates an exploded perspective view of a portion of the ear wearable device 100 shown in FIG. 1 according to an embodiment. FIG. 7 illustrates the state in which the nonconductive cover 530 is separated from the ear wearable device 100 shown in FIG. 1 according to an embodiment.

Referring to FIGS. 6 and 7, in an embodiment, the ear wearable device 100 may include the first housing section 510, the second housing section 520, the nonconductive cover 530, the rim 540, the second supporting member 420, the structure 800, or the ear tip 120.

According to an embodiment, the structure (or a conductive pattern structure) 800 may include a nonconductive first supporting member 410, and a first conductive pattern 610 or a second conductive pattern 620 disposed at the first supporting member 410. According to an embodiment, the first conductive pattern 610 or the second conductive pattern 620 may be implemented by Laser Direct Structuring (LDS). For example, the first conductive pattern 610 or the second conductive pattern 620 may be formed by designing a pattern on the first supporting member using a laser, and then plating a conductive material such as copper or nickel thereon. The first conductive pattern 610 or the second conductive pattern 620 may be disposed on the first supporting member 410 by printing, or other various ways such as an FPCB.

Figure 8:
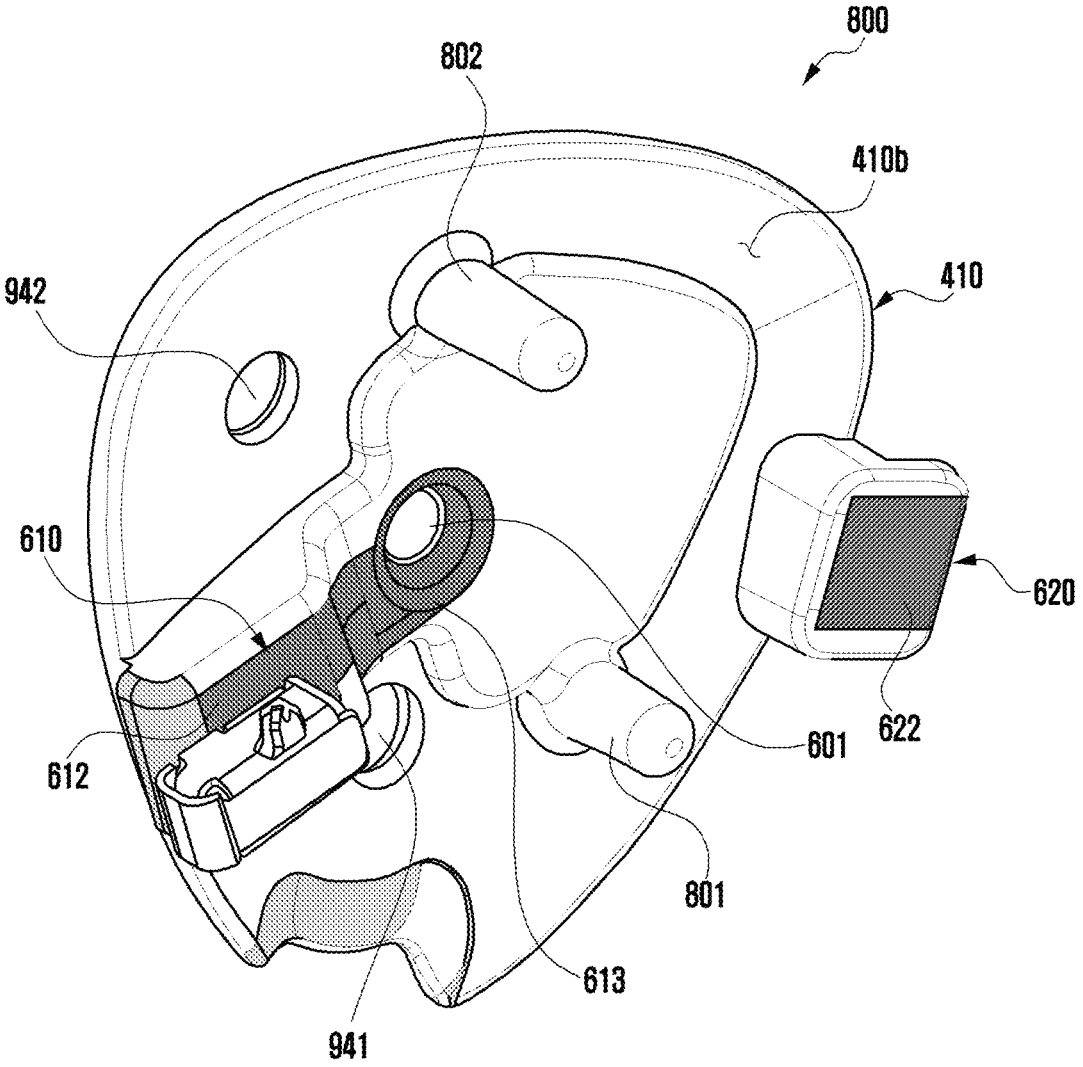
FIG. 8 illustrates a perspective view of a structure according to an embodiment.

FIG. 8 illustrates a perspective view of the structure 800 according to an embodiment.

Referring to FIGS. 6, 7, and 8, in an embodiment, the first supporting member 410 may have a first surface 410*a* facing the nonconductive cover 530, and a second surface 410*b* facing the opposite direction to the first surface 410*a*. The first conductive pattern 610 may have a first conductive portion 611 disposed on the first surface 410*a* and a second conductive portion 612 extending from the first conductive portion 611 and disposed on the second surface 410*b*. The first supporting member 410 may have a first through-hole 601, and the first conductive pattern 610 may have a third conductive portion 613 (see FIG. 8) disposed in the first through-hole 601 and connecting the first conductive portion 611 and the second conductive portion 612. The second conductive pattern 620 may have a fourth conductive portion 621 disposed on the first surface 410*a* and a fifth conductive portion 622 extending from the fourth conductive portion 621 and disposed on the second surface 410*b*. The second conductive pattern 620 may have a sixth conductive portion 623 (see FIG. 7) disposed on a side surface of the second supporting member 420 and connecting the fourth conductive portion 621 and the fifth conductive portion 622. The second conductive portion 612 of the first conductive pattern 610 may be electrically connected with the first printed circuit board 430 through a first flexible conductive member (not shown) disposed on the first printed circuit board 430 shown in FIG. 4 or 5. The fifth conductive portion 622 of the second conductive pattern 620 may be electrically connected with the first printed circuit board 430 through a second flexible conductive member (not shown) disposed on the first printed circuit board 430 shown in FIG. 4 or 5.

According to an embodiment, the first conductive pattern 610 may be electrically connected with the touch sensor IC 332 shown in FIG. 3 and disposed on the first printed circuit board 430 or the second printed circuit board 440 shown in FIG. 4 or 5. The touch detection circuit 331 may have the first conductive pattern 610. The first conductive portion 611 of the first conductive pattern 610 may be a sensing panel that detects and receives user input.

According to an embodiment, the second conductive pattern 620 may be electrically connected with the communication module 390 shown in FIG. 3 and disposed on the first printed circuit board 430 or the second printed circuit board 440 shown in FIG. 4 or 5. The at least one antenna 391 shown in FIG. 3 may have the second conductive pattern 620. According to an embodiment, the communication module 390 can support wireless communication (e.g., Bluetooth communication) through the second conductive pattern 620. At least a portion of the nonconductive cover 530 may be made of a nonconductive material to prevent deterioration of the radiation performance of the second conductive pattern 620.

According to a certain embodiment, the second conductive pattern 620 may not be provided or may be provided in another shape. In this case, the first conductive pattern 610 may be further expanded without being limited to the embodiment shown in the drawings.

According to an embodiment, when seen from above the first surface 410*a*, the fourth conductive portion 621 of the second conductive pattern 620 may be formed in a shape surrounding at least a portion of the first conductive portion 611 of the first conductive pattern 610.

In an embodiment, referring to FIG. 6, the second supporting member 420 may have a first recess 421 in which the first supporting member 410 can be seated. The first supporting member 410 may be fitted in the first recess 421, whereby the coupling force between the first supporting member 410 (or the structure 800) and the second supporting member 420 can be improved. The first recess 421 may have a first opening 701 corresponding to the second conductive portion 612 of the first conductive pattern 610. Referring to FIGS. 6 and 8, the second conductive portion 612 of the first conductive pattern 610 may be electrically connected with the first printed circuit board 430 shown in FIG. 4 or 5 through the first opening 701. For example, the second conductive portion 612 of the first conductive pattern 610 may be positioned close to the first printed circuit board 430 shown in FIG. 4 or 5 through the first opening 701 and may be electrically connected with the first printed circuit board 430 through the first flexible conductive member. The first recess 421 may have a second opening 702 corresponding to the fourth conductive portion 621 of the second conductive pattern 620. Referring to FIGS. 6 and 8, the fourth conductive portion 621 of the second conductive pattern 620 may be positioned close to the first printed circuit board 430 shown in FIG. 4 or 5 through the second opening 702 and may be electrically connected with the first printed circuit board 430 through the second flexible conductive member. Referring to FIG. 8, the portion of the first supporting member 410 on which the second conductive portion 612 of the first conductive pattern 610 is disposed may protrude toward the first printed circuit board 430 shown in FIG. 4 or 5 (e.g., in the direction that the second surface 410*b* of the first supporting member 410 faces), thereby being able to reduce the distance between the second conductive portion 612 and the first printed circuit board 430. Referring to FIG. 8, the portion of the first supporting member 410 on which the fourth conductive portion 621 of the second conductive pattern 620 is disposed may protrude toward the first printed circuit board 430 shown in FIG. 4 or 5 (e.g., in the direction that the second surface 410*b* of the first supporting member 410 faces), thereby being able to reduce the distance between the fourth conductive portion 621 and the first printed circuit board 430.

In an embodiment, referring to FIG. 8, the first supporting member 410 may have a plurality of protrusions 801 and 802 that protrudes from the second surface 410*b*. Referring to FIGS. 6 and 8, the first recess 421 of the second supporting member 420 may have a plurality of first through-holes 711 and 712 in which the first protrusions 801 and 802 can be inserted. The structure in which the first protrusions 801 and 802 are inserted in the first through-holes 711 and 712 can improve the coupling force between the first supporting member 410 (or the structure 800) and the second supporting member 420. The numbers of pieces or the positions of the first protrusions and the first through-holes corresponding to the first protrusions may be varied without being limited to the embodiment shown in FIGS. 6 and 8.

In an embodiment, referring to FIG. 6, the second supporting member 420 may have a ring-shaped second recess 422 surrounding the first recess 421. The first recess 421 is surrounded by the second recess 422 and may be formed deeper than the second recess 422 when seen from above the nonconductive cover 530. The edge of the nonconductive cover 530 may be positioned on the second recess 422.

Referring to FIGS. 6 and 7, according to an embodiment, the first surface 410*a* of the first supporting member 410 may have a third recess 602. The first conductive portion 611 of the first conductive pattern 610 may be at least partially disposed in the third recess 602.

Figure 9:
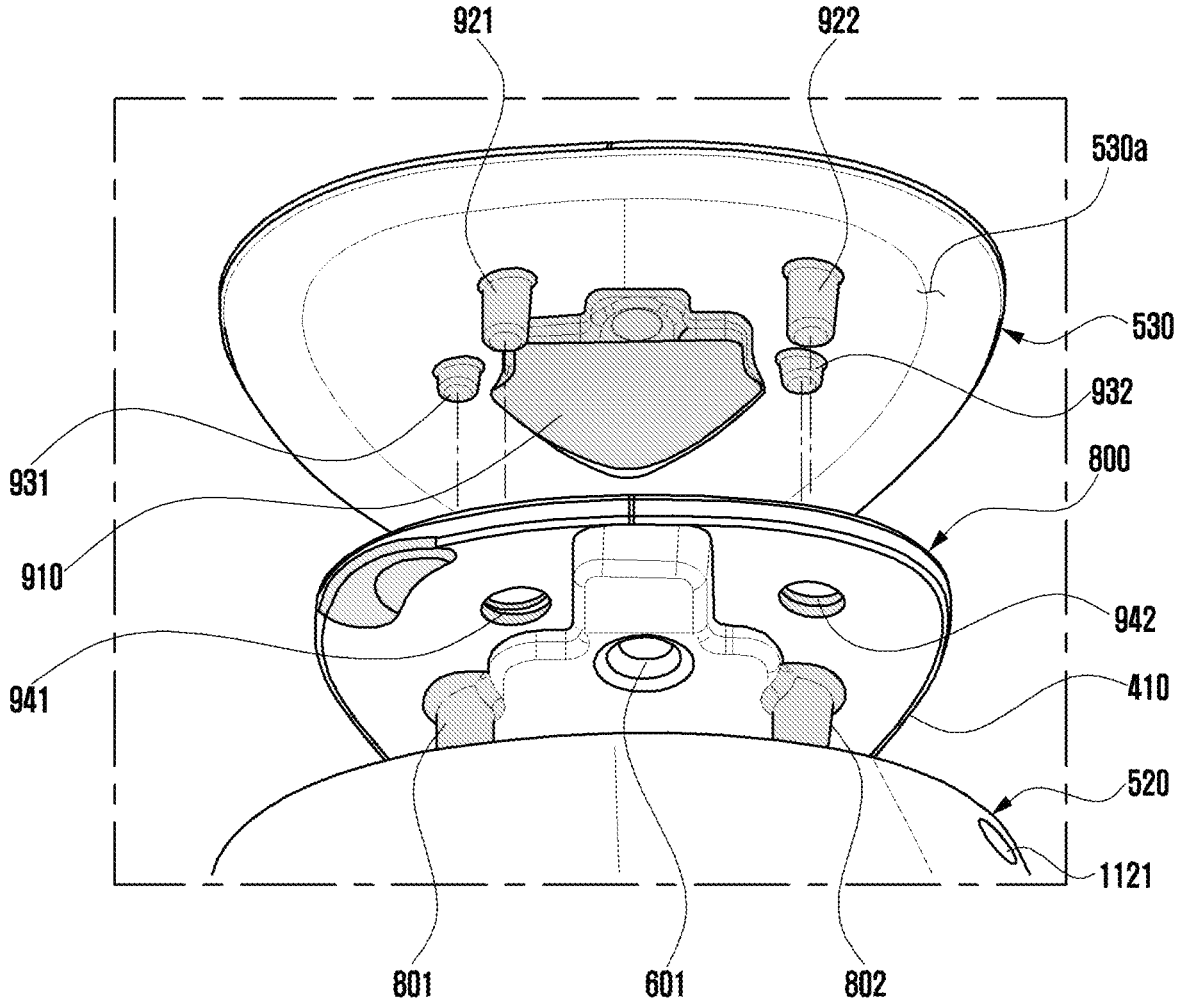
FIG. 9 illustrates an exploded perspective view of a portion of the ear wearable device shown in FIG. 1 according to an embodiment.

FIG. 9 illustrates an exploded perspective view of a portion of the ear wearable device 100 shown in FIG. 1 according to an embodiment.

Referring to FIG. 9, the nonconductive cover 530, for example, may have a third surface 530*a* facing the first supporting member 410. According to an embodiment, the third surface 530*a* may have a protrusion 910 that can be inserted in the third recess 602 shown in FIG. 6. The protrusion 910 can reduce the air gap between the nonconductive cover 530 and the structure 800. The protrusion 910 can improve physical coupling between the nonconductive cover 530 and the structure 800.

In an embodiment, referring to FIGS. 6, 7, and 9, the first supporting member 410 of the structure 800 may have a plurality of second through-holes 941 and 942 around the third recess 602. The nonconductive cover 530 may have a plurality of second protrusions 921 and 922 that protrudes from the third surface 530*a* and can be inserted in the second through-holes 941 and 942. The structure in which the second protrusions 921 and 922 are inserted in the second through-holes 941 and 942 can improve the coupling force between the nonconductive cover 530 and the first supporting member 410 (or the structure 800). In an embodiment, referring to FIG. 6, the first recess 421 of the second supporting member 420 may have a plurality of third through-holes 961 and 962 in which the second protrusions 921 and 922 can be inserted. According to an embodiment, the second protrusions 921 and 922 can be inserted into the third through-holes 961 and 962 of the second supporting member 420 through the second through-holes 941 and 942 of the first supporting member 410. The second protrusions 921 and 922 can improve the coupling force between the nonconductive cover 530, the first supporting member 410 (or the structure 800), and the second supporting member 420. The numbers of pieces or the positions of the second protrusions and the second through-holes corresponding to the second protrusions may be varied without being limited to the embodiment shown in FIGS. 6, 7, and 9.

According to an embodiment, the nonconductive bonding member (not shown) may be at least partially disposed between the structure 800 and the nonconductive cover 530. The nonconductive bonding member may fill the gap between the first supporting member 410 and the nonconductive cover 530 and/or the gap between the first conductive pattern 610 (e.g., the touch detection circuit 331 shown in FIG. 3) and the nonconductive cover 530, and may influence the electromagnetic field that is generated by the first conductive pattern 610. According to an embodiment, the nonconductive bonding member can reduce the air gap between the first supporting member 410 and the nonconductive cover 530 and/or the air gap between the first conductive pattern 610 and the nonconductive cover 530. The nonconductive bonding member not only contribute the physical coupling between the nonconductive cover 530 and the structure 800, but also can increase permittivity related to the electromagnetic field, whereby the performance of detecting user input through the first conductive pattern 610 can be improved.

According to an embodiment, referring to FIGS. 6 and 7, the first supporting member 410 of the structure 800 may have a plurality of fourth recesses 951 and 952 around the third recess 602. Referring to FIGS. 6, 7, and 9, the nonconductive cover 530 may have a plurality of third protrusions 931 and 932 that protrudes from the third surface 530*a* and can be inserted in the fourth recesses 951 and 952. According to an embodiment, the nonconductive bonding member disposed between the nonconductive cover 530 and the structure 800 may extend between the protrusion 910 and the first conductive pattern 610 between the third protrusions 931 and 932 and the fourth recesses 951 and 952. According to an embodiment, the fourth recesses 951 and 952 may be aligned with the first protrusions 801 and 802. The fourth recesses 951 and 952 may be formed at other various positions.

Figure 10:
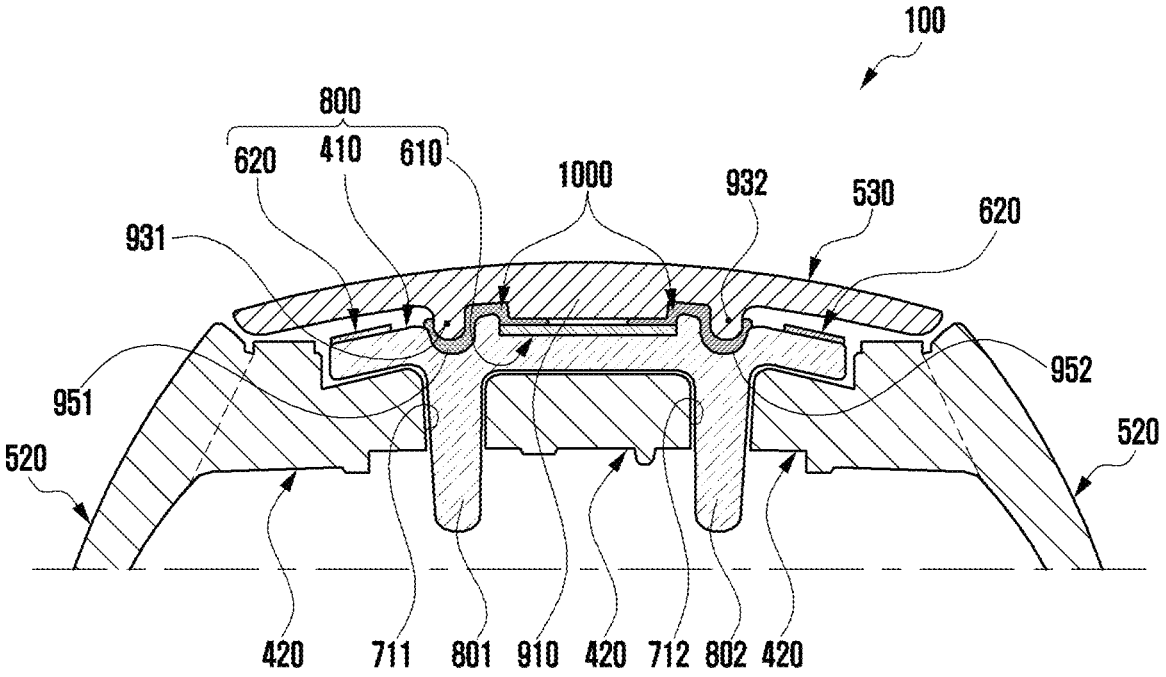
FIG. 10 illustrates a cross-sectional view of the ear wearable device shown in FIG. 1 according to an embodiment.

FIG. 10 illustrates a cross-sectional view of the ear wearable device 100 shown in FIG. 1 according to an embodiment.

Referring to FIG. 10, in an embodiment, the ear wearable device 100 may include the second housing section 520, the second supporting member 420, the nonconductive cover 530, the structure 800, or a nonconductive bonding member 1000.

According to an embodiment, the structure 800 may be positioned between the second supporting member 420 and the nonconductive cover 530. The structure 800 may include a first supporting member 410, and a first conductive pattern 610 or a second conductive pattern 620 disposed at the first supporting member 410. The first protrusions 801 and 802 of the first supporting member 410 may be inserted in the first through-holes 711 and 712 of the second supporting member 420.

According to an embodiment, a nonconductive bonding member 1000 may be disposed between the nonconductive cover 530 and the structure 800. For example, the nonconductive bonding member 1000 may be disposed between the nonconductive cover 530 and the first supporting member 410. A portion of the nonconductive bonding member 1000 may be disposed between the nonconductive cover 530 and the first conductive pattern 610. The nonconductive bonding member 1000 may fill the gap between the first supporting member 410 and the nonconductive cover 530 and/or the gap between the first conductive pattern 610 (e.g., the touch detection circuit 331 shown in FIG. 3) and the nonconductive cover 530, and may influence the electromagnetic field that is generated by the first conductive pattern 610. According to an embodiment, the nonconductive bonding member 1000 can reduce the air gap between the first supporting member 410 and the nonconductive cover 530 and/or the air gap between the first conductive pattern 610 and the nonconductive cover 530. The nonconductive bonding member 1000 not only contribute the physical coupling between the nonconductive cover 530 and the structure 800, but also can increase permittivity related to the electromagnetic field, whereby the performance of detecting user input through the first conductive pattern 610 can be improved. According to an embodiment, the nonconductive bonding member 1000 can maintain the spatial position (e.g., a gap) of the nonconductive cover 530 for the structure including the first conductive pattern 610 and the second conductive pattern 620.

According to an embodiment, the nonconductive bonding member 1000 may extend between the nonconductive cover 530 (e.g., the protrusion 910) and the first conductive pattern 610 between the third protrusions 931 and 932 and the fourth recesses 951 and 952. For example, in a first operation, a liquid-state nonconductive bonding material may be disposed in the fourth recesses 951 and 952. In a second operation, the nonconductive cover 530 can be moved close to the structure 800. A portion of the nonconductive bonding material can flow between the first conductive pattern 610 and the protrusion 910 by the second operation. In a third operation, the nonconductive bonding material is hardened, so the nonconductive bonding member 1000 can be formed. The nonconductive bonding member 1000 may be disposed at various positions between the first conductive pattern 610 and the nonconductive cover 530 without being limited to the embodiment shown in FIG. 10. The numbers of pieces and the positions of the third protrusions 931 and 932 and the fourth recesses 951 and 952 corresponding to the third protrusions may be varied without being limited to the embodiment shown in FIG. 10. According to a certain embodiment (not shown), the fourth recesses 951 and 952 corresponding to the third protrusions 931 and 932 may be formed at the first conductive pattern 610. According to a certain embodiment (not shown), the fourth recesses 951 and 952 corresponding to the third protrusions 931 and 932 may have the opening formed at the first conductive pattern 610. According to a certain embodiment (not shown), the fourth recesses 951 and 952 corresponding to the third protrusions 931 and 932 may have the opening formed at the first conductive pattern 610 and the recesses formed at the second supporting member 420 and aligned with the opening. The method of forming the third protrusions 931 and 932, the fourth recesses 951 and 952, and the nonconductive bonding member 1000 between the structure 800 and the nonconductive cover 530, based on the protrusions and recesses makes it possible to secure both of the coupling force between the structure 800 and the nonconductive cover 530 and the performance of detecting user input through the first conductive pattern 610.

According to an embodiment, the nonconductive bonding member 1000 may include epoxy. The nonconductive bonding member 1000 may include boding materials of other various polymers.

According to a certain embodiment (not shown), the third protrusions 931 and 932 and the fourth recesses 951 and 952 corresponding to the third protrusions may not be provided.

According to an embodiment, the nonconductive bonding member 1000 may not extend between the second conductive pattern 620 and the nonconductive cover 530. According to a certain embodiment (not shown), the nonconductive bonding member 1000 may extend between the second conductive pattern 620 and the nonconductive cover 530.

According to various embodiments (not shown), the structure including the nonconductive cover 530, the structure 800, and the nonconductive bonding member 1000 therebetween may be applied to other various types of electronic devices.

According to an embodiment, an ear wearable device (e.g., the ear wearable device 100 shown in FIG. 1) may include a housing (e.g., the housing 110 shown in FIG. 1 or 2) including a nonconductive cover (e.g., the nonconductive cover 530 shown in FIG. 1 or 2). The ear wearable device may include a speaker positioned in the housing (e.g., the speaker 470 shown in FIG. 5). The ear wearable device may include a structure (e.g., the structure 800 shown in FIG. 6 or 7) positioned in the housing. The structure may include a nonconductive supporting member (e.g., the first supporting member 410 shown in FIG. 6) facing the nonconductive cover and positioned in the housing. The structure may include a first conductive pattern (e.g., the first conductive pattern 610 shown in FIG. 6) positioned on the nonconductive supporting member. The ear wearable device may include a nonconductive bonding member (e.g., the nonconductive bonding member 1000 shown in FIG. 10) positioned between the structure and the nonconductive cover. The ear wearable device may include a touch sensor Integrated Circuit (IC) (e.g., the touch sensor IC 332 shown in FIG. 3) positioned in the housing and electrically connected with the first conductive pattern.

According to an embodiment, the first conductive pattern (e.g., the first conductive pattern 610 shown in FIG. 6) may be formed on the nonconductive supporting member (e.g., the first supporting member 410 shown in FIG. 6) through Laser Direct Structuring (LDS).

According to an embodiment, at least a portion of the nonconductive bonding member (e.g., the nonconductive bonding member 1000 shown in FIG. 10) may overlap the first conductive pattern (e.g., the first conductive pattern 610 shown in FIG. 10).

According to an embodiment, the nonconductive cover (e.g., the nonconductive cover 530 shown in FIG. 10) may have at least one protrusion (e.g., the third protrusions 931 and 932 shown in FIG. 10) protruding toward the nonconductive supporting member (e.g., the first supporting member 410 shown in FIG. 10). The nonconductive supporting member may have at least one recess (e.g., the fourth recesses 951 and 952 shown in FIG. 10) in which the at least one protrusion is inserted. The nonconductive bonding member (e.g., the nonconductive bonding member 1000 shown in FIG. 10) may extend between the at least one protrusion and the at least one recess.

According to an embodiment, the nonconductive supporting member (e.g., the first supporting member 410 shown in FIG. 6 or 7) may have a recess (e.g., the third recess 602 shown in FIG. 6 or 7) facing the nonconductive cover (e.g., the nonconductive cover 530 shown in FIG. 6 or 7). The first conductive pattern (e.g., the first conductive pattern 610 shown in FIG. 6 or 7) may be positioned in the recess.

According to an embodiment, the nonconductive cover (e.g., the nonconductive cover 530 shown in FIG. 9) may have a protrusion (e.g., the protrusion 910 shown in FIG. 9) at least partially inserted in the recess (e.g., the third recess 602 shown in FIG. 6 or 7).

According to an embodiment, the nonconductive supporting member (e.g., the first supporting member 410 shown in FIG. 6) may have a first surface (e.g., the first surface 410*a* shown in FIG. 6) facing the nonconductive cover (e.g., the nonconductive cover 530 shown in FIG. 6) and a second surface (e.g., the second surface 410*b* shown in FIG. 8) facing an opposite direction to the first surface. The first conductive pattern (e.g., the first conductive pattern 610 shown in FIG. 6 or 8) may have a first conductive portion (e.g., the first conductive portion 611 shown in FIG. 6) positioned on the first surface and a second conductive portion (e.g., the second conductive portion 612 shown in FIG. 8) extending from the first conductive portion and positioned on the second surface. The second conductive portion may be electrically connected with the touch sensor IC (e.g., the touch sensor IC 332 shown in FIG. 3).

According to an embodiment, the ear wearable device (e.g., the ear wearable device 100 shown in FIG. 4 or 5) may further include a first printed circuit board (e.g., the first printed circuit board 430 shown in FIG. 4 or 5) positioned in the housing (e.g., the housing 110 shown in FIG. 4 or 5). The second conductive portion (e.g., the second conductive portion 612 shown in FIG. 8) may be electrically connected with the first printed circuit board through a flexible conductive member positioned between the second conductive portion and the first printed circuit board.

According to an embodiment, the ear wearable device (e.g., the ear wearable device 100 shown in FIG. 4 or 5) may further include a second supporting member (e.g., the second supporting member shown in FIG. 4 or 5) positioned between the nonconductive supporting member (e.g., the first supporting member 410 shown in FIG. 4 or 5) and the first printed circuit board (e.g., the first printed circuit board 430 shown in FIG. 4 or 5) and connected with the housing (e.g., the housing 110 shown in FIG. 4 or 5). The second conductive portion (e.g., the second conductive portion 612 shown in FIG. 8) may be electrically connected with the first printed circuit board through an opening (e.g., the first opening 701 shown in FIG. 6) formed at the second supporting member.

According to an embodiment, the ear wearable device (e.g., the ear wearable device 100 shown in FIG. 4 or 5) may further include a battery (e.g., the battery 450 shown in FIG. 4 or 5) positioned in the housing (e.g., the housing 110 shown in FIG. 4 or 5). The first printed circuit board (e.g., the first printed circuit board 430 shown in FIG. 4 or 5) may be positioned between the nonconductive supporting member (e.g., the first supporting member 410 shown in FIG. 4 or 5) and the battery.

According to an embodiment, the ear wearable device (e.g., the ear wearable device 100 shown in FIG. 4 or 5) may further include a microphone (e.g., the microphone 460 shown in FIG. 4 or 5) positioned on the first printed circuit board (e.g., the first printed circuit board 430 shown in FIG. 4 or 5).

According to an embodiment, the ear wearable device (e.g., the ear wearable device 100 shown in FIG. 4 or 5) may further include a second printed circuit board (e.g., the second printed circuit board 440 shown in FIG. 4 or 5) positioned between the speaker (e.g., the speaker 470 shown in FIG. 5) and the battery (e.g., the battery 450 shown in FIG. 4 or 5) and electrically connected with the first printed circuit board (e.g., the first printed circuit board shown in FIG. 4 or 5). The speaker may be electrically connected with the second printed circuit board.

According to an embodiment, the touch sensor IC (e.g., the touch sensor IC 332 shown in FIG. 3) may be positioned on the first printed circuit board (e.g., the first printed circuit board 430 shown in FIG. 4 or 5) or the second printed circuit board (e.g., the second printed circuit board 440 shown in FIG. 4 or 5).

According to an embodiment, the ear wearable device (e.g., the ear wearable device 100 shown in FIG. 4 or 5) may further include a communication module (e.g., the communication module 390 shown in FIG. 3) positioned in the housing (e.g., the housing 110 shown in FIG. 4 or 5). The structure (e.g., the structure 800 shown in FIG. 6 or 7) may further include a second conductive pattern (e.g., the second conductive pattern 620 shown in FIG. 6 or 7) positioned on the nonconductive supporting member (e.g., the first supporting member 410 shown in FIG. 6 or 7). The second conductive pattern may be physically separated from the first conductive pattern (e.g., the first conductive pattern 610 shown in FIG. 6 or 7) and may be electrically connected with the communication module.

According to an embodiment, the first conductive pattern (e.g., the first conductive pattern 610 shown in FIG. 6 or 7) may be at least partially surrounded by the second conductive pattern (e.g., the second conductive pattern 620 shown in FIG. 6 or 7).

According to an embodiment, an electronic device (e.g., the ear wearable device 100 shown in FIG. 4) may include a housing (e.g., the housing 110 shown in FIG. 4 or 5) having a nonconductive region exposed to the outside (e.g., the nonconductive cover 530 shown in FIG. 4 or 5). The electronic device may include a structure (e.g., the structure 800 shown in FIG. 6 or 7) positioned in the housing. The structure may include a nonconductive supporting member (e.g., the first supporting member 410 shown in FIG. 6 or 7) facing the nonconductive region and positioned in the housing. The structure may include a first conductive pattern (e.g., the first conductive pattern 610 shown in FIG. 6 or 7) positioned on the nonconductive supporting member. The electronic device may include a nonconductive bonding member (e.g., the nonconductive bonding member 1000 shown in FIG. 10) positioned between the structure and the nonconductive cover. The electronic device may include a touch sensor IC (e.g., the touch sensor IC 332 shown in FIG. 3) positioned in the housing and electrically connected with the first conductive pattern.

According to various embodiments, the first conductive pattern (e.g., the first conductive pattern 610 shown in FIG. 6 or 7) may be formed on the nonconductive supporting member (e.g., the first supporting member 410 shown in FIG. 6 or 7) through LDS.

According to various embodiments, at least a portion of the nonconductive bonding member (e.g., the nonconductive bonding member 1000 shown in FIG. 10) may overlap the first conductive pattern (e.g., the first conductive pattern 610 shown in FIG. 10).

According to an embodiment, the nonconductive region (e.g., the nonconductive cover 530 shown in FIG. 10) may have at least one protrusion (e.g., the third protrusions 931 and 932 shown in FIG. 10) protruding toward the nonconductive supporting member (e.g., the first supporting member 410 shown in FIG. 10). The nonconductive supporting member may have at least one recess (e.g., the fourth recesses 951 and 952 shown in FIG. 10) in which the at least one protrusion is inserted. The nonconductive bonding member (e.g., the nonconductive bonding member 1000 shown in FIG. 10) may extend between the at least one protrusion and the at least one recess.

According to an embodiment, the electronic device (e.g., the ear wearable device 100 shown in FIG. 4 or 5) may further include a communication module (e.g., the communication module 390 shown in FIG. 3) positioned in the housing (e.g., the housing 110 shown in FIG. 4 or 5). The structure (e.g., the structure 800 shown in FIG. 6 or 7) may further include a second conductive pattern (e.g., the second conductive pattern 620 shown in FIG. 6 or 7) positioned on the nonconductive supporting member (e.g., the first supporting member 410 shown in FIG. 6 or 7). The second conductive pattern may be physically separated from the first conductive pattern (e.g., the first conductive pattern 610 shown in FIG. 6 or 7) and may be electrically connected with the communication module.

Although the present disclosure has been described with various embodiments, various changes and modifications may be suggested to one skilled in the art. It is intended that the present disclosure encompass such changes and modifications as fall within the scope of the appended claims.

What is claimed is:

1. An ear wearable device comprising:

a housing including a nonconductive cover;

a speaker positioned in the housing;

a structure positioned in the housing and including a nonconductive supporting member facing the nonconductive cover and positioned in the housing, and a first conductive pattern positioned on the nonconductive supporting member;

a nonconductive bonding member positioned between the structure and the nonconductive cover; and a touch sensor integrated circuit (IC) positioned in the housing and electrically connected with the first conductive pattern.

2. The ear wearable device of claim 1, wherein the first conductive pattern is formed on the nonconductive supporting member through laser direct structuring (LDS).

3. The ear wearable device of claim 1, wherein at least a portion of the nonconductive bonding member overlaps the first conductive pattern.

4. The ear wearable device of claim 3, wherein:

the nonconductive cover includes at least one protrusion protruding toward the nonconductive supporting member, the nonconductive supporting member includes at least one recess in which the at least one protrusion is inserted, and the nonconductive bonding member extends between the at least one protrusion and the at least one recess.

5. The ear wearable device of claim 1, wherein:

the nonconductive supporting member includes a recess facing the nonconductive cover, and the first conductive pattern is positioned in the recess.

6. The ear wearable device of claim 5, wherein the nonconductive cover includes a protrusion at least partially inserted in the recess.

7. The ear wearable device of claim 1, wherein:

the nonconductive supporting member includes a first surface facing the nonconductive cover and a second surface facing an opposite direction to the first surface, the first conductive pattern includes a first conductive portion positioned on the first surface and a second conductive portion extending from the first conductive portion and positioned on the second surface, and the second conductive portion is electrically connected with the touch sensor IC.

8. The ear wearable device of claim 7, further comprising a first printed circuit board positioned in the housing, wherein the second conductive portion is electrically connected with the first printed circuit board through a flexible conductive member positioned between the second conductive portion and the first printed circuit board.

9. The ear wearable device of claim 8, further comprising a second supporting member positioned between the nonconductive supporting member and the first printed circuit board and connected with the housing, wherein the second conductive portion is electrically connected with the first printed circuit board through an opening formed at the second supporting member.

10. The ear wearable device of claim 8, further comprising a battery positioned in the housing, wherein the first printed circuit board is positioned between the nonconductive supporting member and the battery.

11. The ear wearable device of claim 8, further comprising a microphone positioned on the first printed circuit board.

12. The ear wearable device of claim 8, further comprising a second printed circuit board positioned between the speaker and a battery and electrically connected with the first printed circuit board, wherein the speaker is electrically connected with the second printed circuit board.

13. The ear wearable device of claim 12, wherein the touch sensor IC is positioned on the first printed circuit board or the second printed circuit board.

14. The ear wearable device of claim 1, further comprising a communication module positioned in the housing, wherein the structure further includes a second conductive pattern positioned on the nonconductive supporting member, and wherein the second conductive pattern is physically separated from the first conductive pattern and is electrically connected with the communication module.

15. The ear wearable device of claim 14, wherein the first conductive pattern is at least partially surrounded by the second conductive pattern.

16. An electronic device comprising:

a housing including a nonconductive region exposed to an outside;

a structure positioned in the housing and including a nonconductive supporting member facing the nonconductive region and positioned in the housing, and a first conductive pattern positioned on the nonconductive supporting member;

a nonconductive bonding member positioned between the structure and the nonconductive region; and a touch sensor integrated circuit (IC) positioned in the housing and electrically connected with the first conductive pattern.

17. The electronic device of claim 16, wherein the first conductive pattern is formed on the nonconductive supporting member through laser direct structuring (LDS).

18. The electronic device of claim 16, wherein at least a portion of the nonconductive bonding member overlaps the first conductive pattern.

19. The electronic device of claim 16, wherein:

the nonconductive region includes at least one protrusion protruding toward the nonconductive supporting member, the nonconductive supporting member includes at least one recess in which the at least one protrusion is inserted, and the nonconductive bonding member extends between the at least one protrusion and the at least one recess.

20. The electronic device of claim 16, further comprising a communication module positioned in the housing, wherein the structure further includes a second conductive pattern positioned on the nonconductive supporting member, and wherein the second conductive pattern is physically separated from the first conductive pattern and is electrically connected with the communication module.

* * * * *